United States Patent [19]

Klötzer et al.

[11] 4,263,396

[45] Apr. 21, 1981

[54] DIRECT-POSITIVE PHOTOGRAPHIC MATERIAL

[75] Inventors: Sieghart Klötzer; Erik Moisar, both of Cologne; Harald von Rintelen, Leverkusen, all of Fed. Rep. of Germany

[73] Assignee: AGFA-Gevaert AG, Leverkusen-Bayerwerk, Fed. Rep. of Germany

[21] Appl. No.: 111,166

[22] Filed: Jan. 10, 1980

Related U.S. Application Data

[63] Continuation of Ser. No. 564,042, Apr. 1, 1975, abandoned.

[30] Foreign Application Priority Data

Apr. 6, 1974 [DE] Fed. Rep. of Germany ..... 2416814

[51] Int. Cl.[3] ..... G03C 5/24; G03C 1/34

[52] U.S. Cl. ..... 430/409; 430/611

[58] Field of Search ..... 96/109, 64; 430/409, 430/611

[56] References Cited

U.S. PATENT DOCUMENTS

| | | | |
|---|---|---|---|
| 2,453,346 | 11/1948 | Russell | 430/429 |
| 3,598,598 | 8/1971 | Herz | 430/607 |
| 3,730,723 | 5/1973 | Gilman et al. | 430/409 |
| 3,733,198 | 5/1973 | Vanreusel et al. | 430/409 |
| 3,761,266 | 9/1973 | Milton | 430/409 |
| 3,935,014 | 1/1976 | Klotzer et al. | 430/409 |

*Primary Examiner*—Won H. Louie, Jr.

[57] ABSTRACT

An improvement in the stability of a direct positive emulsion layer in photographic material is obtained by the inclusion of a compound which provides in the image-wise exposed and developed direct positive emulsion layer a greater difference between the density of the image in the unexposed parts of the layer and the density in the exposed parts. The compound provides in the emulsion a characteristic curve related to a density value at maximum density which is at least twice the analogous density value at minimum density.

9 Claims, 5 Drawing Figures

Figure 1:
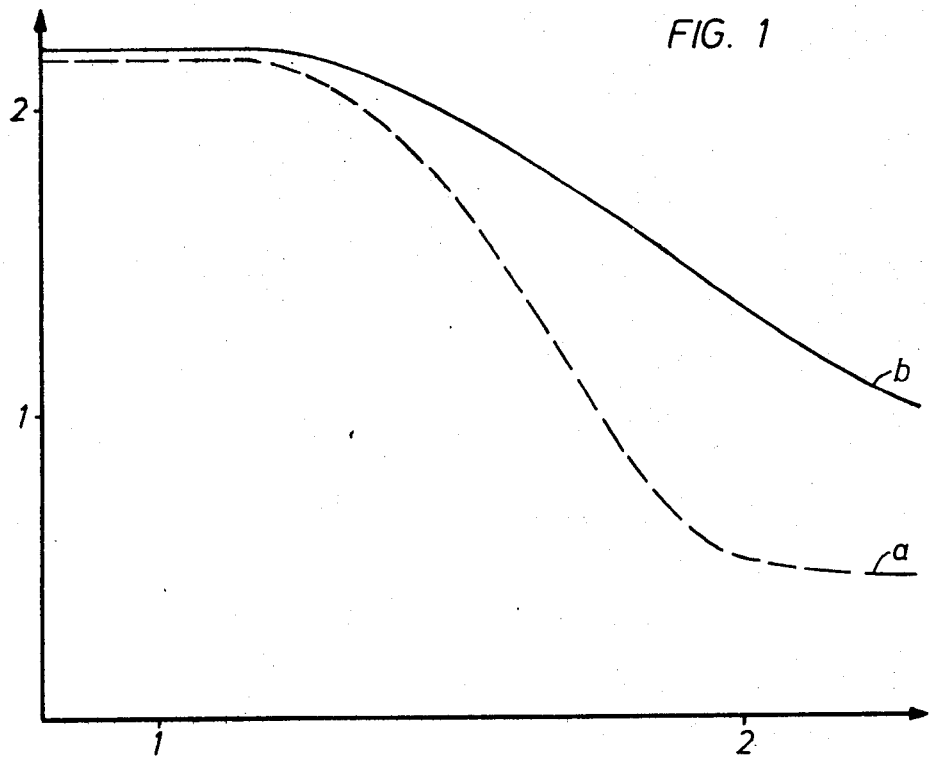
Figure 2:
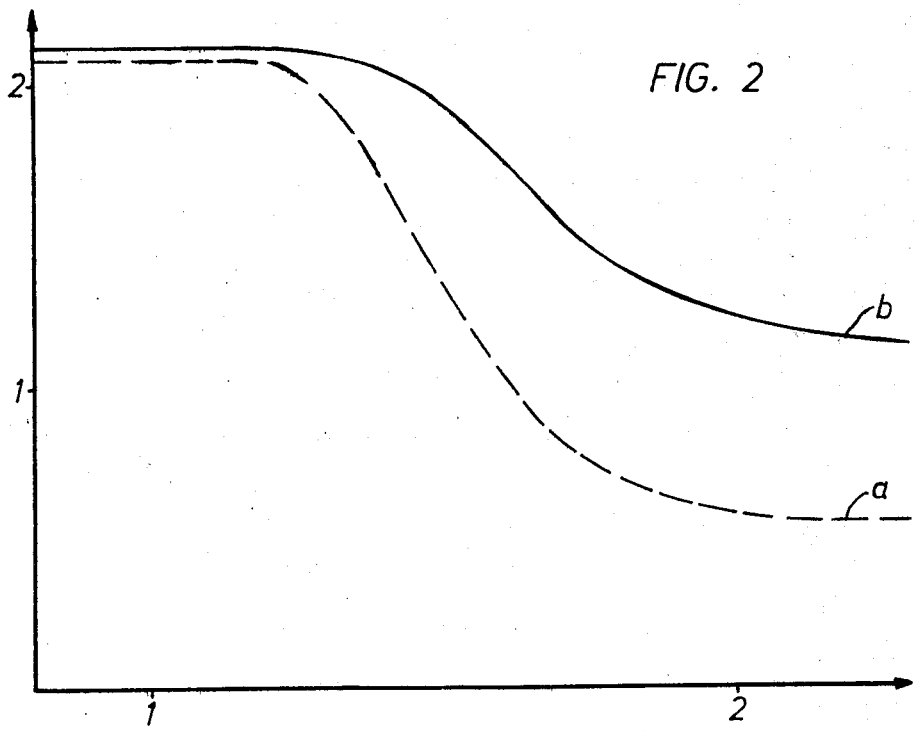

2
1
b
a
1
2

2
1
b
a
1
2

2
1
b
a
1
2

2
1
a
c
b
d
1
2

DIRECT-POSITIVE PHOTOGRAPHIC MATERIAL

CROSS REFERENCE

This application is a continuation of the parent U.S. application Ser. No. 564,042 filed Apr. 1, 1975 by Sieghart Klotzer et al for "Direct-Positive Photographic Material", now abandoned.

This invention relates to a photographic material for producing direct positive photographic images, which contains at least one unfogged silver halide emulsion layer.

Silver halide emulsions which are fogged on the surface are generally used for the production of direct positive photographic images. When the material is exposed to produce an image, the developable fog is destroyed in the exposed areas and preserved in the unexposed areas so that a direct positive image is obtained when the material is developed. The light-sensitivity of the fogged direct positive silver halide emulsions depends on how rapidly the developable fog nuclei on the surface of the silver halide grains are destroyed when the emulsions are exposed to produce an image.

This in turn depends on the size and number of the fog nuclei. If the nuclei are too large, the sensitivity to light is too low. There are, however, limits to the extent by which the light-sensitivity of such direct positive silver halide emulsions can be increased by optimizing the size of the fog nuclei, because a relatively high degree of fogging is necessary in order to obtain a sufficiently high density in the direct positive silver image and relatively small fog nuclei are extremely sensitive to oxidation so that such weakly fogged silver halide emulsions are not sufficiently stable in storage. For these reasons, fogged direct positive silver halide emulsions have remained of minor importance in practice.

Silver halide emulsion layers which are not fogged and which have a substantially higher sensitivity in the interior of the grain than on the surface have also been described for the production of direct positive photographic images. The exposed materials are developed under fogging conditions which cause fogging mainly in the unexposed areas so that a direct positive silver image is obtained on development. The necessary fogging of the exposed layers is achieved either by development with a developer which produces so-called air fogging on exposure to oxygen or by selectively fogging the layers by diffuse exposure or treatment with a fogging agent before or during development. Although a relatively high sensitivity to light has been obtained in such unfogged direct positive silver halide emulsions compared with fogged direct positive emulsions, it was an unsatisfactory feature of such emulsions that the fog was also relatively high in the exposed areas of the layer so that the direct positive images obtained had an interfering background and there was relatively little difference between the areas of highest density and the areas of lowest density.

A certain improvement in this respect can be obtained with the unfogged direct positive silver halide emulsion described in U.S. Pat. No. 3,761,266, but these emulsions do not have the necessary sensitivity to light and are unsatisfactory in their image whites. Moreover, the emulsions described in the said Specification require a certain chemical sensitization of the surface. This chemical sensitization of the surface must be carried out under accurately controlled conditions in order to prevent excessive sensitization. This again has the disadvantage that it is very difficult to obtain reproducible emulsions. A further improvement is provided by the unfogged direct positive silver halide emulsions described in German Offenlegungsschriften No. 2,308,239 and 2,332,802 (or U.S. Patent Applications Ser. No. 442,614 and 482,437). In these emulsions, the light sensitivity is further improved without chemical sensitization of the surface of the silver halide grains. All the known unfogged direct positive silver halide emulsions have, however, one disadvantage which makes these otherwise suitable emulsions difficult to use in practice. This is the lack of stability of precisely those properties which give rise to the direct positive images when fogging development is carried out on the exposed materials. If photographic material of this kind are stored for any length of time, the quality of the positive image obtained on development is seriously impaired by the fact that the exposed areas of the emulsion layer also become developable. This means that a heavy fog is produced and the difference between the density of the image in the unexposed parts of the layer and the density of the interfering fog which is produced when the exposed parts of the layer are developed becomes progressively smaller.

It is among the objects of this invention to produce direct positive photographic materials comprising an unfogged direct positive silver halide emulsion layer which has a high sensitivity to light and the photographic properties of which, in particular its capacity to be developed only in the unexposed parts of the layer by fogging development, remain intact even after prolonged storage under unfavourable climatic conditions.

We now have found a direct positive photographic material comprising at least one unfogged silver halide emulsion in which the silver halide grains have a layered grain structure and contain centres for the deposition of photolytic silver in their interior, i.e. the sensitivity is substantially an internal grain sensitivity, and the emulsion layer contains compounds with a Q value of at least 2, the Q value being the quotient of the density values $D_1$ and $D_2$. To obtain these density values, an unfogged direct positive emulsion containing $10^{-2}$ to 10 millimol of said compound per mol of silver which is in the form of silver halide applied in an amount corresponding to 3.1 g of silver per $m^2$ is first exposed stepwise by means of a grey wedge, stored for 72 hours at 60° C. and 40% relative humidity and then treated in the following developer:

1 g of acetylphenylhydrazine,
10 g of N-ethyl-N-hydroxyethyl-p-phenylenediamine,
2 g of sodium sulphite,
40 g of trisodium phosphate,
5 g of sodium hydroxide,
0.05 g of benzimidazole,
water up to 1000 ml for 5 minutes at a temperature of 20° C. and then fixed in an acid fixing bath, the density values $D_1$ and $D_2$ referring to exposures at light intensities of $I_1$ and $I_2$, where $I_1$ is that intensity of exposure at which the tangent to the density curve at half maximum density of a comparison sample obtained without this compound and without temperature treatment cuts the horizontal which passes through the maximum density, and $I_2$ is that intensity of exposure at which the tangent to the density curve of the same emulsion cuts the horizontal passing through the minimum density. The compounds according to the invention which are added to the direct positive emulsion should reduce the value of the developable maximum density compared with that of a comparison emulsion which has the same silver halide content but is free from stabilizer by less than 50%.

The Q value which characterises the compounds used according to the invention is determined as follows:

TEST EMULSION

A homodisperse silver chloride emulsion with a particle size of 0.2 μm was prepared by controlled double inflow of 3 N silver nitrate and 3 N sodium chloride solutions into a previously prepared 5% solution of inert gelatine. Silver bromide was precipitated on this emulsion by further addition of 3 N silver nitrate and 3 N potassium bromide solutions until the length of edge of the cubical crystals was 0.6 μm. The emulsion was solidified and washed in the usual manner and then adjusted to a pAg of 9 with potassium bromide. The stabilizer which is required to be tested is added in increasing quantities ranging from $10^{-2}$ to 10 millimol per mol of silver to samples of the finished emulsion prepared as described above which has a silver content of 105 g of silver per kg. The samples are then cast on a film support in a quantity corresponding to an application of silver halide of 3.1 g/m$^2$. The film samples are kept at a temperature of 60° C. and relative humidity of 40% for 72 hours. They are then exposed behind a grey wedge and developed for 5 minutes in a developer of the following composition 1 g of acetylphenylhydrazide,
10 g of N-ethyl-N-hydroxyethyl-p-phenylenediamine,
2 g of sodium sulphite,
40 g of trisodium phosphate,
5 g of sodium hydroxide,
0.05 g of benzimidazole
made up to 1000 ml with water and then fixed in an acid fixing bath. The sensitometer wedges obtained in this way are assessed as follows:

The optical density D of the layer is measured as a function of the exposure intensity I. Two points of the density curve ($D_1$ and $D_2$) which correspond to the exposure values $I_1$ and $I_2$ are determined. The value for $I_1$ is determined by that exposure intensity at which the tangent to the density curve at half maximum value of a comparison layer without stabilizer and which has not been stored at 60° C. and has been developed in the fogging developer described above intersects the horizontal passing through the maximum density. $I_2$ is similarly determined by the value along the abscissa of the intensity scale at which the tangent to the density curve intersects the horizontal passing through the minimum density. The quotient $Q=D_1/D_2$ is obtained from the values $D_1$ and $D_2$ corresponding to $I_1$ and $I_2$ obtained with emulsions which contain the stabilizer and which have been stored and developed as described above.

Compounds which when used in a quantity within the range given above result in a Q value of at least 2 are suitable for the material according to the invention.

The chemical structure of the compounds used according to the invention is not critical. They are generally organic heterocyclic compounds with N-heterocyclic rings which contain a mercapto group. This chemical class also includes conventional stabilizers for stabilizing chemically sensitized silver halide emulsions against the formation of developable fog nuclei. The compounds used according to the invention, however, have nothing in common in their function with conventional antifogging agents. This is clear not only from the fact that the mechanism by which they operate is completely different since the emulsions concerned here are of a special type, namely unfogged direct positive emulsions, but also by the fact that many of the best known and most effective conventional stabilizers or antifogging agents are quite unusable for the purpose of the invention.

The effect of antifogging agents in conventional photographic emulsions, e.g. negative emulsions, is based on the fact that they prevent conversion of the ripening nuclei which are produced on the grain surface by chemical ripening into developable fog nuclei. Since the unfogged direct positive emulsions to which this invention is applicable virtually have not and must not have any ripening nuclei on the grain surface, the effect of the heterocyclic compounds used in accordance with the invention must be based on a different mechanism.

Since the present invention is based on a novel effect which has nothing to do with classical stabilization, it follows that many of the well known antifogging agents which are highly effective for conventional silver halide emulsions are unusable for the present invention. A case in point, for example, is the well known stabilizer 1-phenyl-5-mercaptotetrazole. The one factor which determines the effectiveness of a compound in accordance with the invention is the Q value defined above, which should be greater than 2. The Q value of phenylmercaptotetrazole, for example, is too low. The following compounds, for example, have proved to be usable:

1.

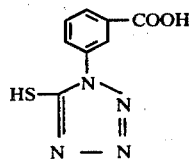

2.

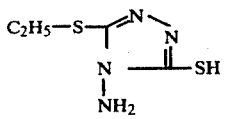

3.

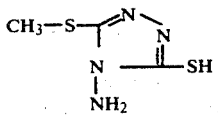

4.

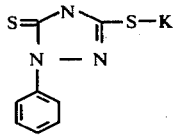

5.

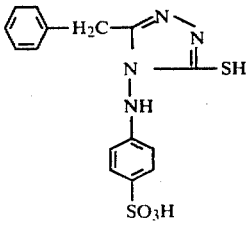

-continued

6.

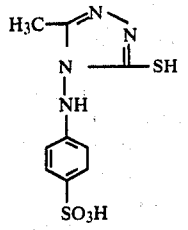

7.

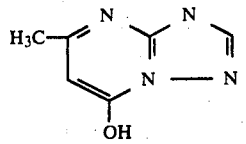

The above compounds are known in the literature and can be prepared by the usual methods.

The preparation of compound 1 has been described in "Chemische Berichte" 86, 314 and in "Canadian Journal of Chemistry" 37, 101.

PREPARATION OF COMPOUND 2

22.7 g (1/10 mol) of 1-amino-2,5-dimercapto-1,3,4-triazolemonopyridinium salt (see Acta Chim. Scand. 15, page 1295 (1961)) were dissolved in 200 ml of water by heating. A solution of 8 ml (1/10 mol) of ethyl iodide in 80 ml of ethanol was then added dropwise at 40° C. and the mixture was stirred at this temperature for several hours. After cooling, it was suction filtered and recrystallised from ligroin/isopropanol.

12.5 g (~71%) of 1-amino-2-ethylmercapto-5-mercapto-1,3,4-triazole with a melting point of 172° C. are obtained in this way.

PREPARATION OF COMPOUND 3

14.8 g (1/10 mol) of 1-amino-2,5-dimercapto-1,3,4-triazole and 7.91 g of pyridine are dissolved in 250 ml of dimethylformamide in the heat. 6.25 g of methyl iodide (1/10 mol) are then added dropwise at 85° to 90° C. After 12 hours' stirring at 100° C. (bath temperature), the mixture is cooled and the dimethylformamide is evaporated off. The residue crystallises when triturated with water. After recrystallisation from water, 13 g of 1-amino-2-methylmercapto-5-mercapto-1,2,4-triazole with a melting point of 189° C. are obtained. The yield was 80% of the theory, (see also Acta. Chim. Scand. 15, page 1295).

The preparation of compound 4 is described in "Beilsteins Handbuch der organischen Chemie", 4th Edition, published by Julius Springer, Berlin 1937, Volume 27, page 678.

Compounds 5 and 6 are prepared by condensation of thiocarbohydrazide and its derivatives with o-formic acid esters or iminoethers as described below.

PREPARATION OF COMPOUND 5

1-(p-Sulphonic acid-phenylamino)-2-benzyl-5-mercapto-1,3,4-triazole was prepared by suspending 26.2 g of $N_1$-p-sulphonic acid-phenylthiocarbohydrazine in 250 ml of ahydrous methanol, adding 100 ml of a 1/10 molar solution of ammonia in anhydrous methanol and finally rapidly adding a solution of 22 g of benzyliminoether hydrochloride in 125 ml of anhydrous methanol. When the reaction mixture is heated, the ammonium salt of 1-(p-sulphonic acid-phenylamino)-2-benzyl-5-mercapto-1,3,4-traizole precipitates. The melting point of the free acid was 309°-311° C. with decomposition and the yield was 70% of the theory.

$N_1$-p-Sulphonic acid-phenyl-thiocarbohydrazide was prepared by dissolving 205 g of phenylhydrazine-p-sulphonic acid ammonium in a mixture of 400 ml of water, 200 ml of alcohol and 40 g of sodium hydroxide and then adding 80 g of carbon disulphide dropwise at about 40° C. The mixture is then heated to 50° C. for a short time, cooled and 126 g of dimethylsulphate were added with careful cooling. When the reaction was completed, the alcohol was evaporated off under vacuum and gaseous hydrogen chloride was introduced into the remaining aqueous solution until most of the sodium chloride formed had precipitated. The reaction mixture was suction filtered, hydrogen chloride gas was again passed through and the mixture was cooled. The methyl ester which crystallised from the reaction mixture was suction filtered and recrystallised from concentrated hydrochloric acid. 295 g of the above product were dissolved in 300 ml of alcohol at 40° to 50° C., and 150 ml of 91% hydrazine hydrate were added with stirring. An exothermic reaction set in and the mixture soon separated into two layers. Heating was continued for one hour at 60° C., 2 l of water were added and the reaction mixture was neutralised with hydrochloric acid. The compound which precipitated was suction filtered and recrystallised several times from water. The melting point was 195° to 200° C. with decomposition.

Preparation of compound 6 of 1-(p-sulphonic acid-phenylamino)-2-methyl-5-mercapto-1,3,4-triazole was carried out similarly to the preparation of 1-(p-sulphonic acid-phenylamino)-2benzyl-5-mercapto-1,3,4-triazole. 5.6 g of $N_1$-p-sulphonic acid-phenyl-thiocarbohydrazide, the preparation of which has been described in connection with compound 5, were dissolved by heating in 50 ml of anhydrous methanol which contained 1/50 mol ammonia 2.4 g of acetiminoether were added and the whole mixture was heated under reflux. The mass of crystals which precipitated was suction filtered and recrystallised from a little water. The melting point was 291° C. with decomposition.

The preparation of tetra- and pentaazaindenes has been described by Birr in "Zeitschrift für wissenschaftliche Photographie", Volume 47, pages 2 to 28 (1952).

Emulsions which contain centres for the photolytic deposition of silver in the interior are suitable for the purpose of the invention, that is to say emulsions in which the internal sensitivity is substantially higher than the surface sensitivity. Those emulsions in which the sensitivity is substantially confined to the interior are particularly preferred.

The emulsions used according to the invention should therefore be superficially chemically sensitised to only a very slight extent, if at all. When samples of the exposed material according to the invention are developed with a surface developer of the following composition:

| | |
|---|---|
| p-Hydroxyphenylglycine | 10 g |
| sodium carbonate (cryst.) | 100 g |
| water up to | 1000 ml |

there should preferably be no silver image produced or only one of a very slight density whereas a silver image of sufficient density should be produced when an internal image developer of the following composition is used:

| | |
|---|---|
| Hydroquinone | 15 g |
| Monomethyl-p-aminophenolsulphate | 15 g |
| Sodium sulphite (anhydrous) | 50 g |
| Potassium bromide | 10 g |
| Sodium hydroxide | 25 g |
| Sodium thiosulphate (cryst.) | 20 g |
| Water up to | 1000 ml. |

At any event, when the photographic material according to the invention is exposed stepwise for periods ranging from 100 to 1 second and developed for 3 minutes at 20° C. in the internal image developer described above, it should attain a maximum density at least three times greater but preferably at least 5 times greater than that achieved in a material which has been exposed in the same manner and developed in the surface developer described above (development time 4 minutes at 20° C.).

The required high internal grain sensitivity of the emulsions used, which is due to centres in the interior of the grain which promote formation of photolytic silver, can be achieved in various ways. It has been found particularly suitable to use silver halide emulsions in which the grains have a layered grain structure and which consist of silver halides phases containing differing amounts of various silver halides. The internal grain sensitivity is determined by the properties of the phase boundary surfaces or transition between the phases which consist of the various silver halides. Emulsions of this kind have been described, for example, in German Offenlegungsschriften Nos. 2,308,239 and 2,332,808 (our U.S. Patent Applications Ser. Nos. 442,614 and 482,437). Silver halide emulsions in which the silver halide grains contain foreign inclusions can also be used. These emulsions generally have a layered grain structure. They can be prepared by first producing a fine grain silver halide emulsion in which the grains form the core for the final emulsion. This starting emulsion can be chemically or physically modified on the surface. A shell consisting of the same or a different silver halide is then precipitated on the core. The preparation of such an emulsion has been described, for example, in British patent specification No. 1,027,146. Reference may also be made in U.S. Pat. No. 3,206,313; 3,317,322 and 3,367,778. In the case of the last mentioned Patent Specification, the surface is not fogged. Other suitable processes have been described in U.S. Pat. No. 3,447,927; 3,531,291 and 3,271,157 and in British Patent Specifications Nos. 1,027,146 and 1,151,782. The above mentioned foreign inclusions may consist either of foreign metal ions of a different valency or of noble metal nuclei, e.g. of silver, gold, platinum, palladium or iridium, and/or of nuclei which are formed by reaction with labile sulphur compounds. The silver halide emulsions used according to the invention may also be prepared by precipitating the silver halide grains in the presence of foreign metal ions, in particular polyvalent metal ions. This can be achieved, for example, by adding aqueous solutions of salts of the given metal during precipitation. Suitable salts of this kind include e.g. salts of divalent lead or of trivalent antimony, bismuth, arsenic, gold, iridium or rhodium and salts of tetravelent platinum or iridium. The concentration of the foreign inclusions may vary within wide limits but concentrations of the order of at least $10^{-7}$ to $10^{-5}$ mol percent, based on the total silver halide content of the grain, are generally sufficient.

The silver halide emulsions used according to the invention are prepared by known methods commonly used for the preparation of silver halide emulsions with a layered grain structure. So-called double jet methods at given pAg and pH values are preferably employed. Emulsions with a layered grain structure and processes for their preparation have been described in British patent specification No. 1,027,146. Reference may also be made to the publications by E. MOISAR and S. WAGNER in "Berichte der Bunsengesellschaft für physikalische Chemie" 67 (1963), pages 356–359 and P. Claes and R. Berendsen in "Photographische Korrespondenz" 101 (1965), pages 37–42. The pAg values which must be kept adjusted during precipitation can be continuously measured by electrometric means, and the measurements can be used to control the rate of inflow of the precipitation components.

Both homodisperse and heterodisperse silver halide emulsions are suitable for the material according to the invention. By heterodisperse silver halide emulsions are meant emulsions with a wide grain size distribution in which preferably at least 10%, and most preferably at least 20% by weight of the silver halide grains have a diameter which deviates from the average grain diameter by at least 40%.

The silver halide grains have a substantially irregular form. The absolute value of the average grain size may vary within wide limits. Both fine grained heterodisperse silver halide emulsions with an average diameter of less than 0.5 μm, preferably less than 0.3 μm, and coarse grained heterodisperse emulsions with average grain sizes of between 0.5 and 4 μm may be used, depending on the purpose for which the photographic material is intended.

Homodisperse silver halide emulsions with a narrow grain size distribution are also suitable for the material according to the invention. Preferably about 95% by weight of the silver halide grains have a diameter which deviates by not more than 40% and preferably not more than 30% from the average grain diameter.

The silver halide grains may have any of the usual forms, e.g. they may be cubical or octahedric or also tetradecahedric mixed forms.

The absolute value of the average grain size may vary within wide limits. Both fine grained monodisperse silver halide emulsions with an average diameter of less than 0.5 μm and preferably less than 0.3 μm and coarse grained mono-disperse emulsions with an average grain size between 0.5 and 2 μm may be used, depending on the purpose for which the photographic material is intended.

The usual hydrophilic layer-forming substances may be used as protective colloids or binders for the silver halide emulsion layer, e.g. proteins, in particular gelatine; alginic acid or its derivatives such as esters, amides or salts thereof; cellulose derivatives such as carboxymethyl cellulose and cellulose sulphates; starches or their derivatives or hydrophilic synthetic binders such as polyvinyl alcohol; partly saponified polyvinyl acetate and polyvinyl pyrrolidone. The hydrophilic binders in the layers may also be mixed with other synthetic binders in a dissolved or dispersed form, such as homopolymers or copolymers of acrylic or methacrylic acid or their derivatives such as esters, amides or nitriles, or vinyl polymers such as vinyl esters or vinyl ethers.

The usual supports may be used for the photographic material according to the invention, e.g. cellulose ester supports, such as cellulose acetate or cellulose acetobutyrate, or polyesters such as polyethylene terephthalate or polycarbonates, especially those based on bisphenylol propane. Paper supports are also suitable. These may contain water-impermeable polyolefine layers made e.g. of polyethylene or polypropylene; glass or metal supports may be used.

The silver halide emulsions used according to the invention may contain the usual emulsion additives, provided only that care is taken to ensure that the surface sensitivity is kept as low as possible.

The emulsions may also be spectrally sensitized. Suitable sensitizers for this purpose include e.g. the usual mono- or polymethine dyes such as acid or basic cyanines, hemicyanines, streptocyanines, merocyanines, oxonols, hemioxonols, styryl dyes and others, also trinuclear or higher nuclear methine dyes, for example rhodacyanines or neocyanines.

Sensitizers of this kind have been described, for example, in the work by F.M. Hamer "The Cyanine Dyes and related compounds" (1964), Interscience Publishers John Wiley and Sons.

The photographic materials according to the invention are exposed imagewise in the usual manner and then developed in so-called surface developers to cause fogging. By surface developers are meant development baths which do not contain any silver halide solvents and are therefore unable to develop any developable fog nuclei or latent image nuclei situated in the interior of the grain. Surface developers can only reduce latent image nuclei or developable fog nuclei situated on the surface of the silver halide grain to a silver image. The usual photographic developers may be used. For colour development processes, the photographic materials according to the invention may be treated with the usual colour forming developers, particularly those based on p-phenylenediamine. Mixtures of various developer substances may, of course, be used for processing the exposed materials.

The developer substances may be added either to the aqueous development bath or to the photographic material itself, e.g. to the silver halide emulsion layer or to an adjacent layer. If the developer substances are contained in a layer of the photographic material, development is carried out with a so-called activator bath the main component of which is an alkali for adjusting the bath to the pH required for development but it may also contain additives to promote and control development. After development, the material can be fixed and washed in the usual manner.

As already mentioned above, the photographic materials according to the invention, which contain at least one unfogged, direct positive silver halide emulsion layer, are developed under fogging conditions after exposure, this development being carried out by methods known per se.

Thus, for example, developers of a particular composition which produce a so-called air fog in the presence of atmospheric oxygen may be used. Developers of this kind have been described e.g. in U.S. Pat. No. 2,497,875.

Fogging may also be effected by diffuse exposure to light, e.g. flash exposure immediately before or during development. Processes of this kind have been described e.g. in German patent specification No. 854,888; U.S. Pat. Nos. 2,456,953 and 2,592,298 and in British patent specification Nos. 1,150,553; 1,151,363; 1,195,387; 1,195,838 and 1,187,029.

According to a third method, fogging may be carried out by treating the exposed layer with a reducing agent before or during development. Suitable fogging agents are in particular hydrazine and substituted hydrazines such as alkyl or arylhydrazines, hydrazine carboxylic acid, acylated hydrazines, alkylsulphonamidoarylhydrazines, naphthylhydrazine sulphonic acids and other hydrazine derivatives. Reference may be made to U.S. Pat. Nos. 2,563,785; 2,588,982 2,604,400; 2,618,656, 2,663,732; 2,675,318; 2,685,514; 3,227,552 or 3,565,620 or to British patent specification No. 1,269,640.

Quaternary ammonium salts are also suitable fogging agents which may be used alone or together with hydrazines, particularly the cyclic quaternary ammonium salts described in U.S. Pat. No. 3,615,615, or heterocyclic quaternary salts according to U.S. Pat. Nos. 3,734,738 and 3,719,494.

The fogging agents, like the developer substances, may be employed either in one of the layers of the photographic material or in the development bath. It is also possible to treat the exposed layers with an aqueous solution of the fogging agent before development.

The concentration of fogging compound may vary within wide limits. It depends on the desired effect, the strength of the fogging agent or the nature of the unfogged direct positive silver halide emulsion. The optimum concentration for any given purpose can be determined by a few simple tests.

The developer may also contain the usual additives for photographic developers such as antioxidants, sequestering agents, stabilizers, particularly those of the benzotriazole series or organic, particularly heterocyclic mercapto compounds, and development accelerators of the usual kind, particularly derivatives of polyalkylene oxides or quaternary ammonium compounds.

In some cases, it may be advantageous if compounds which liberate iodide ions when processed are added to the photographic material or to one of the treatment baths. Reference may be made to British patent specifications Nos. 1,151,363; 1,187,029 and 1,195,837.

The material according to the invention may also contain halogen acceptors in known manner, particularly those which are relatively difficult to reduce but relatively easily oxidized.

The present invention may be employed for the production of both black and white and coloured photographic images. Thus, for example, depending on the gradation of the silver halide emulsion layer, the photographic material may be used for photo-technical purposes if it has a steep gradation or for producing black and white continuous-tone images or X-ray images if it has a medium or flat gradation. Coloured photographic direct positive images may be produced e.g. according to the known principle of chromogenic development in the presence of colour couplers which react with the oxidation products of colour producing p-phenylenediamine developers to form dyes.

The colour couplers may be added to the direct positive, unfogged silver halide emulsion layers or to the developer in accordance with the principle of the so-called developing-in process. Incorporation of a colour coupler in the emulsion layer can be achieved by the usual methods, for example water-soluble colour couplers which contain one or more sulpho or carboxyl groups in the form of the free acid or a salt may be added to the casting solution for the emulsion from an aqueous solution, optionally in the presence of alkali. Colour couplers which are insoluble or insufficiently soluble in water are added in the form of solutions in a suitable high boiling, oil forming or low boiling organic solvent or solvent mixture which may be miscible or immiscible with water. This solution may be dispersed in the aqueous solution of a protective colloid, optionally in the presence of a surface active agent.

When multilayered colour photographic materials with a transparent support layer are used, the present invention may also be employed for producing direct positive, transparent photographic colour images. The black-and-white development and diffuse intermediate exposure to light normally required for reversal processes are then unnecessary. The material according to the invention may also be used in known manner for the silver dye bleaching process. In that case, negative images of the original are obtained since the image is once more reversed at the colour bleaching stage.

The present invention may be employed particularly advantageously for instant colour processes or dye transfer processes in known manner. In these processes, the dyes for the partial colour images diffuse into an image receiving layer where they become firmly fixed, or the colour couplers diffuse into the image receiving layer where they are converted into the image dye after the usual colour-forming development.

The light-sensitive element generally consists of three light-sensitive emulsion layers each of which is associated with a colour producing system. By colour producing system is meant a compound incorporated in a diffusion-fast form in the given layer, which compound constitutes a dye or a dye precursor which when developed in the presence of the alkaline processing substance, reacts with the oxidation products of photographic developers which are formed imagewise to split off diffusible dyes which preferably contain acid groups. Various chemical compounds are available for this purpose. The diffusion-fast colour producing substances according to U.S. Pat. No. 3,628,952, for example, are particularly suitable. These compounds split off diffusible dyes when they react with the oxidation products of black-and-white developers or colour developers. Another suitable class of compounds has been described in U.S. Pat. No. 3,227,550. The compounds mentioned there react with the oxidized colour developer to produce diffusible dyes which generally belong to the series of azomethine dyes. Another suitable colour producing system has been described in U.S. Pat. Nos. 3,443,939 and 3,443,940. In this system, the liberation of diffusible dyes by the action of oxidized developer substances is accompanied by ring closure.

Colour transfer processes and couplers which are used in such processes and may also be used for the purpose of the present invention have been described in U.S. Pat. Nos. 2,983,606; 3,087,817; 3,185,567; 3,227,550; 3,227,551; 3,227,552; 3,227,554; 3,253,915; 3,415,644; 3,415,645 and 3,415,646. The light-sensitive materials used for such instant colour processes generally have the following structure:

blue sensitive silver halide emulsion layer
layer containing a system which liberates a yellow dye
separating layer
green sensitive silver halide emulsion layer
layer which liberates a magenta dye
separating layer
red sensitive silver halide emulsion layer
layer containing a system which liberates a cyan dye
image receptor layer
neutralizing system.

In the graphs shown in FIGS. 1 to 5, which are explained in more detail in the following Examples, the density has been plotted along the ordinate against the relative log I.t value along the abscissa.

EXAMPLE 1

An unfogged direct positive emulsion is prepared as follows:

A silver chloride emulsion with a cubical crystal structure of grains having a length of edge of 0.25 μm is prepared by the double jet method by simultaneously adding 3 N potassium chloride and 3 N silver nitrate solutions controlled by the pAg. Silver bromide was precipitated on this silver chloride starting emulsion by further double inflow of potassium bromide and silver nitrate solutions. The resulting emulsion was homo-disperse and contained cubical grains with a length of edge of 0.65 μm and a silver chloride content of 5.8 mols percent. The above emulsion is applied to a composite layer in an amount of 2.8 g silver halide per $m^2$ with the addition of 95 mg of compound 1 per mole silver halide and a dye of the following formula

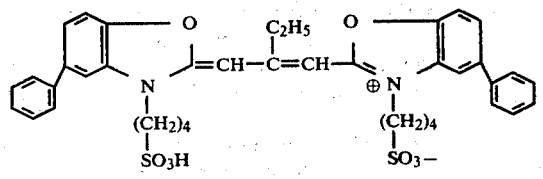

which sensitizes the emulsion to the green region of the spectrum. The composite layer to which the emulsion is applied consists of three elements. The lower-most element is a 5 μm image receiving layer prepared by coating an aqueous solution of 50 g gelatin and 30 g octadecyl trimethylammonium sulfate per liter on a cellulose triacetate support. The next element is a 3 μm reflection layer prepared by coating a dispersion of 1000 g titanium dioxide in 1 liter of a 5% aqueous gelatin solution. Above this is a layer which contains the diffusion variable magenta dye according to U.S. Pat. No. 3,628,952 of the following formula:

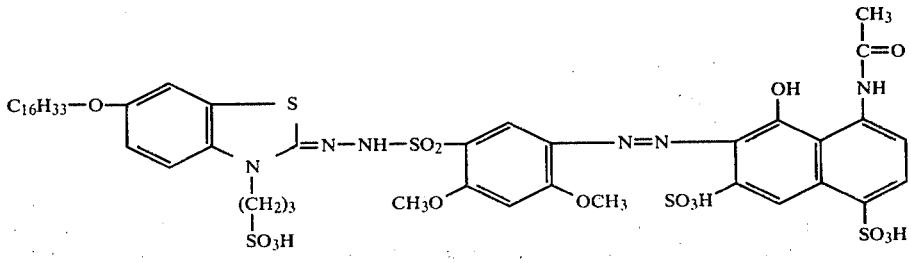

and a diffusion-fast colour developer according to U.S. Pat. No. 3,705,035 of the following formula:

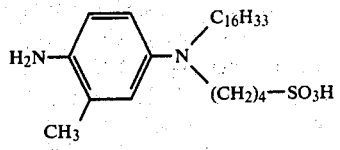

After exposure behind a step wedge and development with a developer paste of the following composition:
25 g of potassium hydroxide
10 ml of benzyl alcohol
5 g of N,N-tetramethyl-p-phenylenediamine
35 g of hydroxyethylcellulose
1 g of acetylphenylhydrazide
water up to 1000 ml
the magenta dye which has been liberated by the developer oxidation product diffuses into the image receiving layer. The colour density curves shown in FIG. 1 were obtained from sensitometric measurements, curve (a) corresponding to the emulsion layer which was cast with the addition of stabilizer and curve (b) representing the colour densities of a comparison layer which was free from stabilizer.

FIG. 1 clearly shows the improvement in the image whites obtained by the addition of compound 1. Compound 1 produces a Q value of 4.3 in the test described above.

EXAMPLE 2

An unfogged direct positive emulsion is prepared as follows:

(A) A homodisperse silver bromide emulsion with cubical crystals with a length of edge of about 0.2 μm was prepared by pAg controlled simultaneous inflow of 3 N potassium bromide and 3 N silver nitrate solutions to a 3% gelatine solution which had been heated to 50° C.

(B) Seven times the quantity of silver halide was precipitated on this silver bromide emulsion by pAg controlled simultaneous triple inflow of 3 N potassium bromide, 3 N potassium chloride and 3 N silver nitrate solutions, the chloride content being continuously raised to 100% in the course of precipitation and again lowered to 0, based on the halide solutions poured in. The total quantity of silver chloride incorporated amounted to 15 mols % of the total quantity of silver halide precipitated on the silver bromide grains provided. A homo-disperse silver halide emulsion with cubical grains with a length of edge of about 0.4 μm and a silver chloride content (now based on the total grain) of 13.1 mols % was obtained.

After addition to the above emulsion of 70 g of a diffusion-fast magenta coupler of the formula

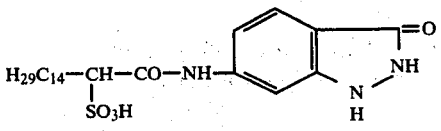

per mol of silver halide and 140 mg of compound 5 per mol of silver halide and the same quantity of sensitizing dye as in Example 1, the emulsion was applied to a white pigmented cellulose acetate support in a quantity corresponding to 1.45 g of Ag/m². The layer obtained in this way as well as a comparison layer not containing compound 5 was stored at 60° C. and 40% relative humidity for 72 hours. After exposure behind a step wedge and development in a developer of the following composition:
1 g of acetylphenylhydrazide,
10 g of N-ethyl-N-hydroxyethyl-p-phenylenediamine,
2 g of sodium sulphite,
40 g of trisodium phosphate,
5 g of sodium hydroxide,
0.055 g of benzimidazole
water up to 1000 ml,
the layers were bleach fixed in the usual manner. Sensitometric measurements were carried out to produce the colour density curves in FIG. 2 in which curve a represents the layer containing compound 5 and curve b represents the comparison layer which is free from stabilizer. The stabilizing effect is seen from the distinctly better image whites. Compound 5 produces a Q value of 3.8 in the test described above.

EXAMPLE 3

An image receiving layer, a reflection layer and above this a layer containing the diffusion variable cyan dye of the formula

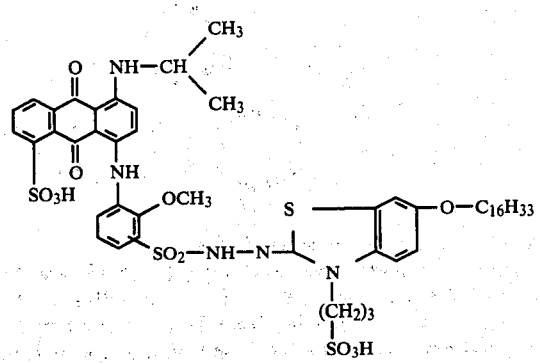

and a diffusion-fast phenylene diamine developer according to Example 1 were applied to a composite layer element as described in Example 1 consisting of a transparent support cellulose acetate the image receiving layer and the pigmented lager. A layer of the direct positive emulsion mentioned in Example 1 which contained a dye of the formula

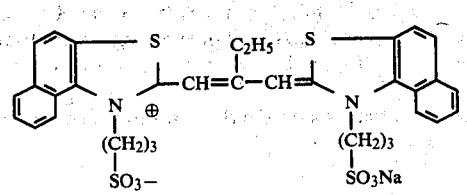

which sensitizes to the red region of the spectrum and 120 mg of compound 6 per mol of silver halide was cast on top of the above layers in an amount corresponding to 3 g of silver halide per m². Both this layer and a comparison layer not containing compound 6 were stored at 60° C. and 40% relative humidity for 72 hours. After exposure and development with the developer paste mentioned in Example 1, the colour density curves shown in FIG. 3 were obtained from sensitometric measurements. Curve (a) corresponds to the emulsion layer cast with the addition of stabilizer and curve (b) is the colour density curve of the comparison layer which was free from stabilizer.

Figure 3:
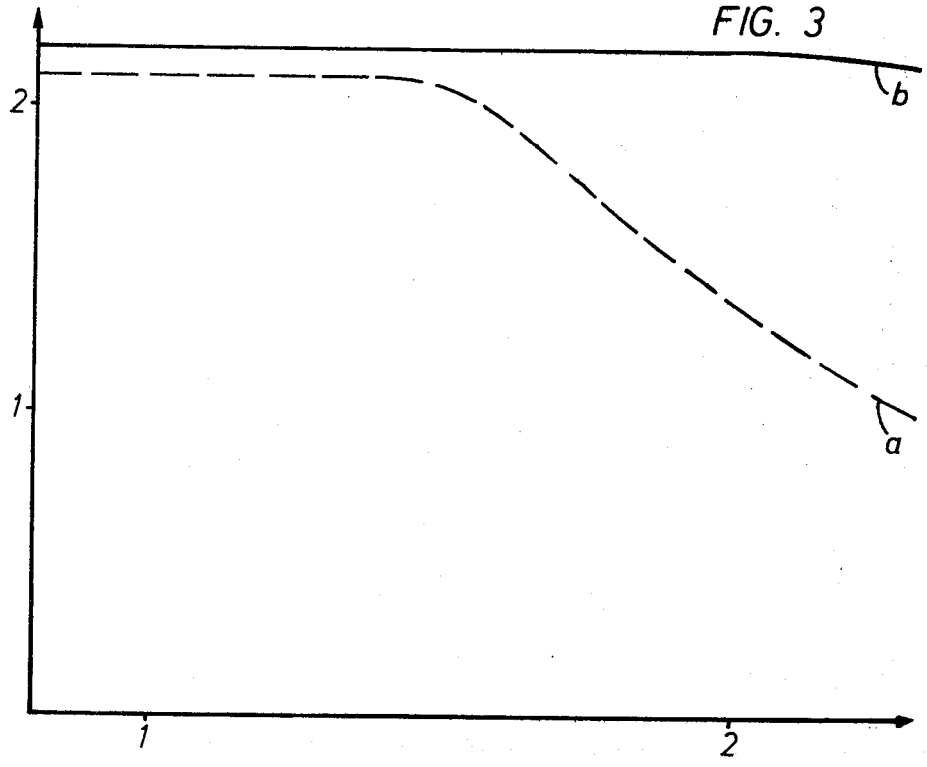

FIG. 3 clearly shows the improvement in image whites obtained by the addition of compound 4.

Compound 6 produces a Q value of 4.0 in the tests described above.

EXAMPLE 4

This Example illustrates that if compounds which can normally be used as stabilizers but produce Q values of less than 2 in the test described above are added to the direct positive emulsion, they do not produce the effect according to the invention. Layers were prepared as in Example 3 but instead of compound 6, various other known stabilzers were added to the emulsion samples:

(a) 35 mg of the compound

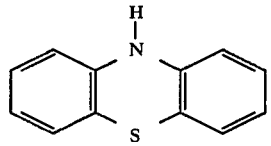

(b) 35 mg of the compound

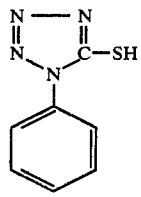

(c) 35 mg of the compound

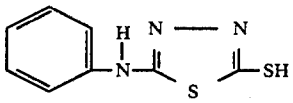

in each case per mol of silver halide.

Figure 4:
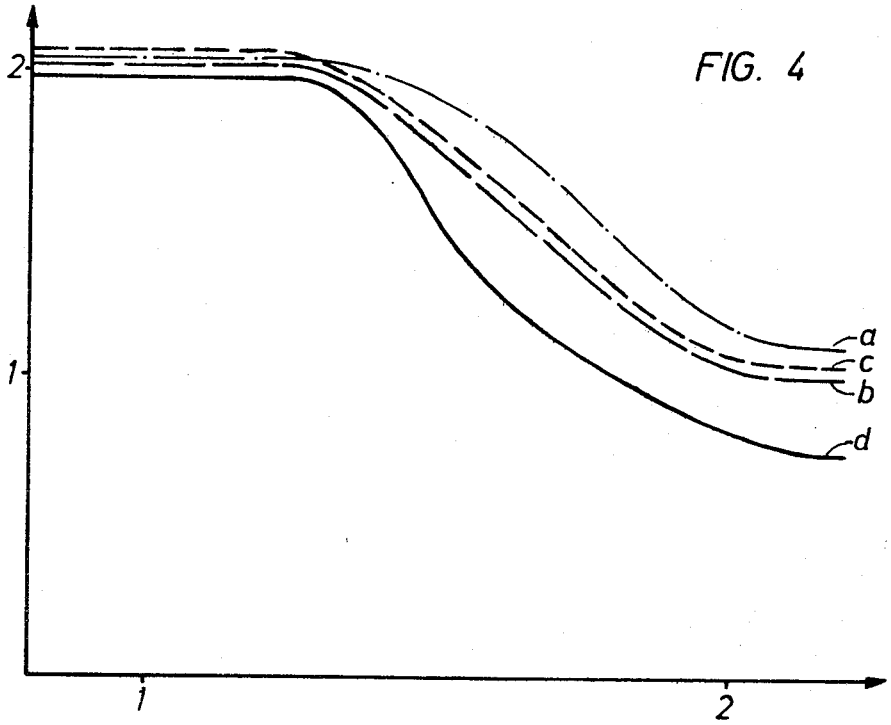

The colour density curves (a) to (c) in FIG. 4 were obtained after exposure and development with a developer paste as described in Example 1, colour density curve (d) being the curve obtained with a comparison layer which has free from stabilizer. The layers containing additives (a) to (c) produce inferior image whites to those obtained with layer (d) which is free from additive.

Figure 5:
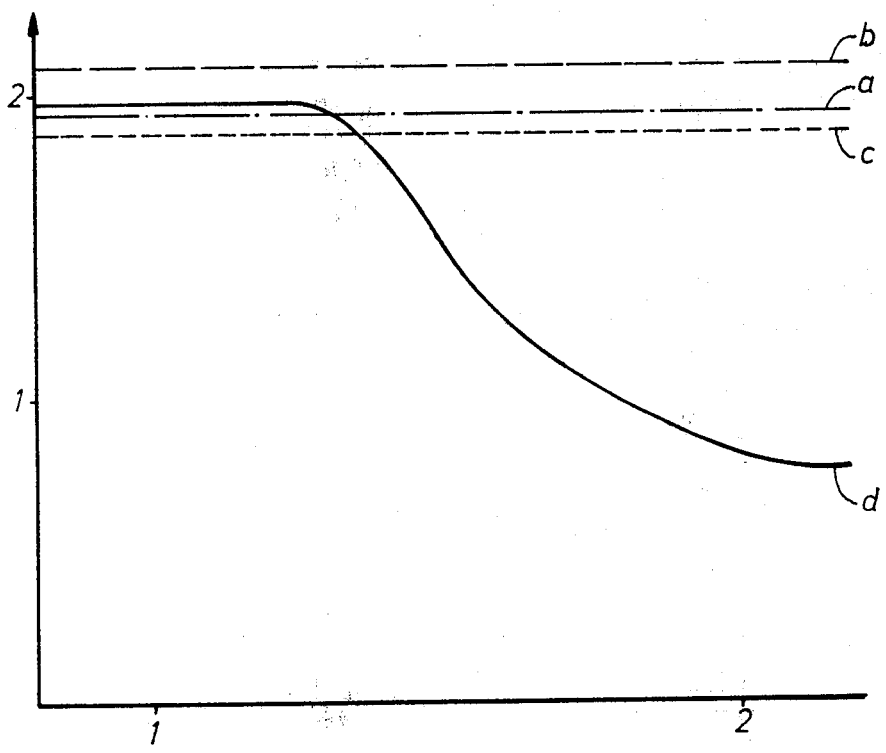

In a parallel test, layers (a) to (c) were stored at 60° C. and 40% relative humidity for 72 hours, exposed and developed as described above. The colour density curves are shown in FIG. 5, curve (d) again representing the layer which was free from stabilizer and had not been treated in the heating cupboard. None of the compounds (a) to (c) is capable of preventing severe fogging of the layers during the treatment in the heating cupboard.

The Q values obtained in the test described above are as follows:

(a) Q=1.0
(b) Q=1.1
(c) Q=1.3.

We claim:

1. A light sensitive photographic material having a direct positive emulsion of improved stability comprising a support and on the support at least one unfogged silver halide emulsion layer containing silver halide grains of a layered grain structure and containing centers for the deposition of photolytic silver within the grains wherein the improvement comprises the silver halide emulsion contains a stabilizing compound which maintains exposed areas of the silver halide emulsion from becoming developable and having a Q value of at least 2, the Q value being the quotient of the density values $D_1$ and $D_2$ which are produced by exposing said unfogged direct positive emulsion containing $10^{-2}$ to 10 millimol of the said compound per mol of silver and 3.1 g of silver per $m^2$ in the form of silver halide behind a grey wedge, storing the exposed layer at 60° C. and 40% relative humidity for 72 hours and treating it in the following developer:

1 g of acetylphenylhydrazine,
10 g of N-ethyl-N-hydroxyethyl-p-phenylenediamine,
2 g of sodium sulphite
40 g of trisodium phosphate,
5 g of solium hydroxide,
0.05 g of benzimidazole
Water up to 1000 ml for 5 minutes at 20° C. and then fixing it is an acid fixing bath, the density values $D_1$ and $D_2$ referring to exposures at intensities $I_1$ and $I_2$ where the first density value $D_1$ refers to the first exposure intensity $I_1$ and the second density value $D_2$ refers to the second exposure intensity $I_2$, said first exposure intensity $I_1$ being the intensity of exposure at which the tangent to the density curve of an exposed and developed layer of said silver halide emulsion free of said stabilizing compound and absent said temperature and humidity treatment intersects the value of maximum density of said compound-free emulsion, said tangent being at half the maximum density of said compound-free emulsion and the second exposure intensity $I_2$ being the intensity of exposure at which said tangent to the density curve at half the maximum density of said compound-free emulsion intersects the value of the minimum density thereof, the maximum density of said emulsion containing said stabilizing compound being reduced by less than 50% of said maximum density of said compound-free emulsion, said stabilizing compound is a mercapto-substituted N-heterocyclic compound which has a Q value of at least 2.

2. Material according to claim 1 wherein said mercapto-substituted N-heterocyclic compound which has a Q value of at least 2 is a tetrazole, triazole or thiadiazole compound which is substituted with a mercapto group at the heterocyclic ring and has a Q value of at least 2.

3. Material according to claim 2, wherein said compound of the following formula:

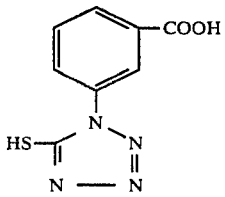

4. Material according to claim 2, wherein said compound is of the following formula:

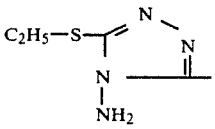

5. Material according to claim 2, wherein said compound is of the following formula:

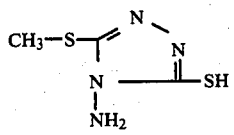

6. Material according to claim 2, wherein said compound is of the following formula:

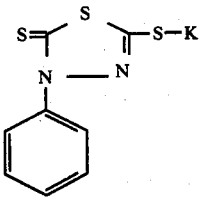

7. Material according to claim 2, wherein said compound is of the following formula:

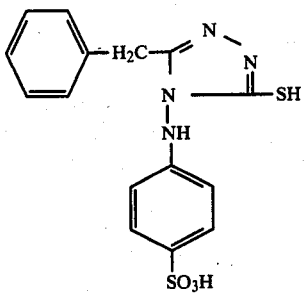

8. Material according to claim 2, wherein said compound is of the following formula:

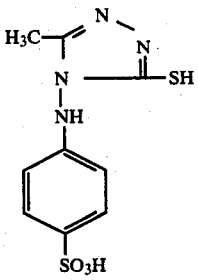

9. In the preparation of an image in a direct positive photographic material the steps of preparing a photographic material with at least one layer of supported unfogged direct positive silver halide emulsion containing silver halide grains of a layered grain structure and containing centers for deposition of photolytic silver within the grains, exposing the photographic material to light having varying intensities and developing the exposed material in a surface developer at fogging conditions wherein the improvement comprises, exposing a photographic material with an unfogged direct positive silver halide emulsion layer containing a stabilizing compound which maintains exposed areas of the silver halide emulsion from becoming developable and having a Q value of at least 2, the Q value being the quotient of the density values $D_1$ and $D_2$ which are produced by exposing said unfogged direct positive emulsion containing $10^{-2}$ to 10 millimol of the said compound per mol of silver and 3.1 g of silver per $m^2$ in the form of silver halide behind a grey wedge, storing the exposed layer at 60° C. and 40% relative humidity for 72 hours and treating it in the following developer:

1 g of acetylphenylhydrazine,
10 g of N-ethly-N-hydroxyethyl-p-phenylenediamine,
2 g of sodium sulphite
40 g of trisodium phosphate,
5 g of sodium hydroxide
0.05 g of benzimidazole
water up to 1000 ml for 5 minutes at 20° C. and then fixing it in an acid fixing bath, the density values $D_1$ and $D_2$ referring to exposures at intensities $I_1$ and $I_2$ where the first density value $D_1$ refers to the first exposure intensity $I_1$ and the second density value $D_2$ refers to the second exposure intensity $I_2$, said first exposure intensity $I_1$ being the intensity of exposure at which the tangent to the density curve of an exposed and developed layer of said silver halide emulsion free of said stabilizing compound and absent said temperature and humidity treatment intersects the value of maximum density of said compound-free emulsion, said tangent being at half the maximum density of said compound-free emulsion and the second exposure intensity $I_2$ being the intensity of exposure at which said tangent to the density curve at half the maximum density of said compound-free emulsion intersects the value of the minimum density thereof, the maximum density of said emulsion containing said stabilizing compound being reduced by less than 50% of said maximum density of said compound-free emulsion, said stabilizing compound is a mercapto-substituted N-heterocyclic compound which as a Q value of at least 2.

* * * * *